United States Patent [19]

Gozzi

[11] Patent Number: 4,478,556

[45] Date of Patent: Oct. 23, 1984

[54] THREE OR FOUR STAGE GAS COMPRESSOR

[76] Inventor: Antonio Gozzi, 14, Via Giordano, 41050 Montale Rangone, Modena, Italy

[21] Appl. No.: 370,385

[22] Filed: Apr. 21, 1982

[30] Foreign Application Priority Data

Apr. 21, 1981 [IT] Italy ..... 40044 A/81
Apr. 21, 1981 [IT] Italy ..... 40045 A/81

[51] Int. Cl.[3] ..... F04B 3/00

[52] U.S. Cl. ..... 417/256; 417/254; 417/264; 417/266; 417/397

[58] Field of Search ..... 417/254, 393, 466, 255, 417/256, 257, 258, 259, 260, 261, 262, 263, 264, 265, 266, 267, 268, 397

[56] References Cited

U.S. PATENT DOCUMENTS 2,479,856 8/1949 Mitton ..... 417/397
4,334,833 6/1982 Gozzi ..... 417/258

*Primary Examiner*—Carlton R. Croyle
*Assistant Examiner*—Donald E. Stout
*Attorney, Agent, or Firm*—Browdy and Neimark

[57] ABSTRACT

The invention concerns a three- or four-stage gas compressor comprising two interconnecting compression units operated by hydraulic pistons; the first unit comprises a central hydraulic section flanked by two identical and symmetrical lateral sections each incorporating the first and third stages and operated by an alternating hydraulic piston; the second unit comprises a central hydraulic section of lesser diameter than that of unit one but with equal volume of oil, and two lateral sections similar to those of unit one but of lesser diameter. In the four-stage embodiment the lateral sections of unit two comprise between them the second and fourth compression stages, while in the three-stage embodiment the lateral sections of the second unit comprise only a single section each of the second compression stage. The oil chambers relative to each unit's central section interconnect—in either embodiment—by way of a compensating valve. For each single stroke of the first compression unit's piston in central section, the corresponding piston in the central section of the second unit completes a contrariwise single stroke: the consumer unit thus receives a delivery of gas per single stroke of the piston in the first unit's said central section.

4 Claims, 2 Drawing Figures

THREE OR FOUR STAGE GAS COMPRESSOR

The invention concerns a three or four stage gas compressor, that is, a machine for compressing gaseous volumes such as air, nitrogen, methane and the like from atmospheric pressure, or from pressures more or less than atmospheric, to very much higher pressure values by means of three or four compression stages. Current technology in this already includes a four stage gas compressor, subject of Canadian patent application No. 361.552 dated Oct. 3, 1980 made by the same inventor, wich comprises simple and compact unit designed to reach a resultant ratio of $4^4=256$ using a compression ratio of 4 to 1 for each stage, or even higher if the compression ratios increased: this unit consists of a single mobile entity furnished axially with a double-acting central hydraulic mover piston, and two pistons for the first and second gas compression stages respectively: the hollow rod of each piston constituting the compression chamber relative to the third and the fourth stage, these being operated by the movement of their respective rods with respect to fixed pistons located at their opposed respective extremities.

Current technology such as it is stands in need of further refinement with regard to the fact that in the aforementioned four stage compressor there can be only one complete suction and compression cycle for every one completed action of the central hydraulic piston that is, on complete cycle per two strokes: the delivery stroke and the return stroke of the piston itself; moreover the abovementioned compressor's members are asymmetrically disposed.

It became apparent furthermore that the use of a four stage compressor is hardly worthwhile when the resulting pressure required is of order of 10 atm or little more. The above outline demonstrates a need for solution of those technical problems posed by a three or four stage compressor wich will reach, and even surpass the optimum resultant pressure ratio achieved by using a compression ratio of approximately 4–1 for each stage, that is, from atmospheric pressure up to $4^3$ or $4^4$ atms. and achieve this with double the volumetric working capacity of that permitted by the previous invention in other words a capacity to deliver the product of one complete compression cycle to the consumer unit per single stroke of the central hydraulic mover piston; hence assuming the first stage piston's velocity and diameter as par, the actual volumetric working capacity per single cycle is doubled.

A first form of embodiment of the invention resolves the abovementioned technical problems by adopting a four stage compressor comprising two units (or assemblies) each consisting of a central section with an hydraulically operated alternating piston and two lateral compression sections.

The first unit comprises the first and third stages in its respective lateral sections while the second unit comprises the second and fourth gas compression stages in like manner; the hydraulic chamber serving the first unit interconnects with that serving the second by way of compensating, valve.

The different stages of the two units are interconnected thus; suction in the first section of the first stage with suction in the second section of the first stage and with the reservoir containing gas for compression; delivery in the first section of the first stage with suction in the first section of the second stage; delivery in the second section of the first stage with suction in the second section of the second stage; suction in the first section of the third stage with delivery in the first section of the second stage; suction in the second section of the third stage with delivery in the second section of the second stage; delivery in the first section of the third stage with suction in the first section of the fourth stage; delivery in the second section of the third stage with suction in the second section of the fourth stage; delivery in the first and second sections of the fourth stage with the reservoir destined to receive the compressed gas.

Basically with respect to the four stage compressor contained in one single unit, by reproducing the first and third stage symmetrically one eliminates stages two and four: furthermore it is flanked by second unit with second and fourth stages reproduced symmetrically and combining with the similarly reproduced first and third stages.

The advantages obtained from this form of embodiment of the invention are the following: assuming as par the first stage piston diameter, velocity, and resulting compression, the obtention of a doubled volume of compressed gas within the given unit of time; equilibrium between the assembled units various forces in play by virtue of the symmetrical nature of their design, and economical manufacturing cost and improved function. In a second form of embodiment of the invention, the compressor, this time in three stages, comprises two units, (or assemblies) each consisting of a central section with an hydraulically operated alternating piston and two lateral compression sections.

The first unit comprises the first and third stages in its respective lateral sections whilst the second unit, which flanks the first, comprises the second stage this being subdivided into two sections laterally disposed with respect to the central hydraulic section: the hydraulic chamber serving the first unit interconnects with that serving the second by way of a compensating valve.

The different stages of the two units are connected thus: suction in the first section of the first stage with suction in the second section of the first stage and with the reservoir containing gas for compression; delivery in the first section of the first stage with suction in the second section of the second stage; suction in the first section of the third stage with delivery in the second section of the second stage; delivery in the first section of the third stage with delivery in the second section of the third stage and with the consumer unit.

The three-stage embodiment particularly suitable when compression requirements fall below those obtainable with the four-stage embodiment, obviates the superfluous use of four stages at a compression ratio markedly less than 4–1; thus the optimum resultant compression ratio with the three-stage embodiment is $4^3=64$.

This second embodiment of the compressor offers a more simple construction at a lower cost by virtue of the elimination of the fourth compression stage.

The invention will now be described by way of example, with reference to the accompanying drawings in which.

Figure 1:
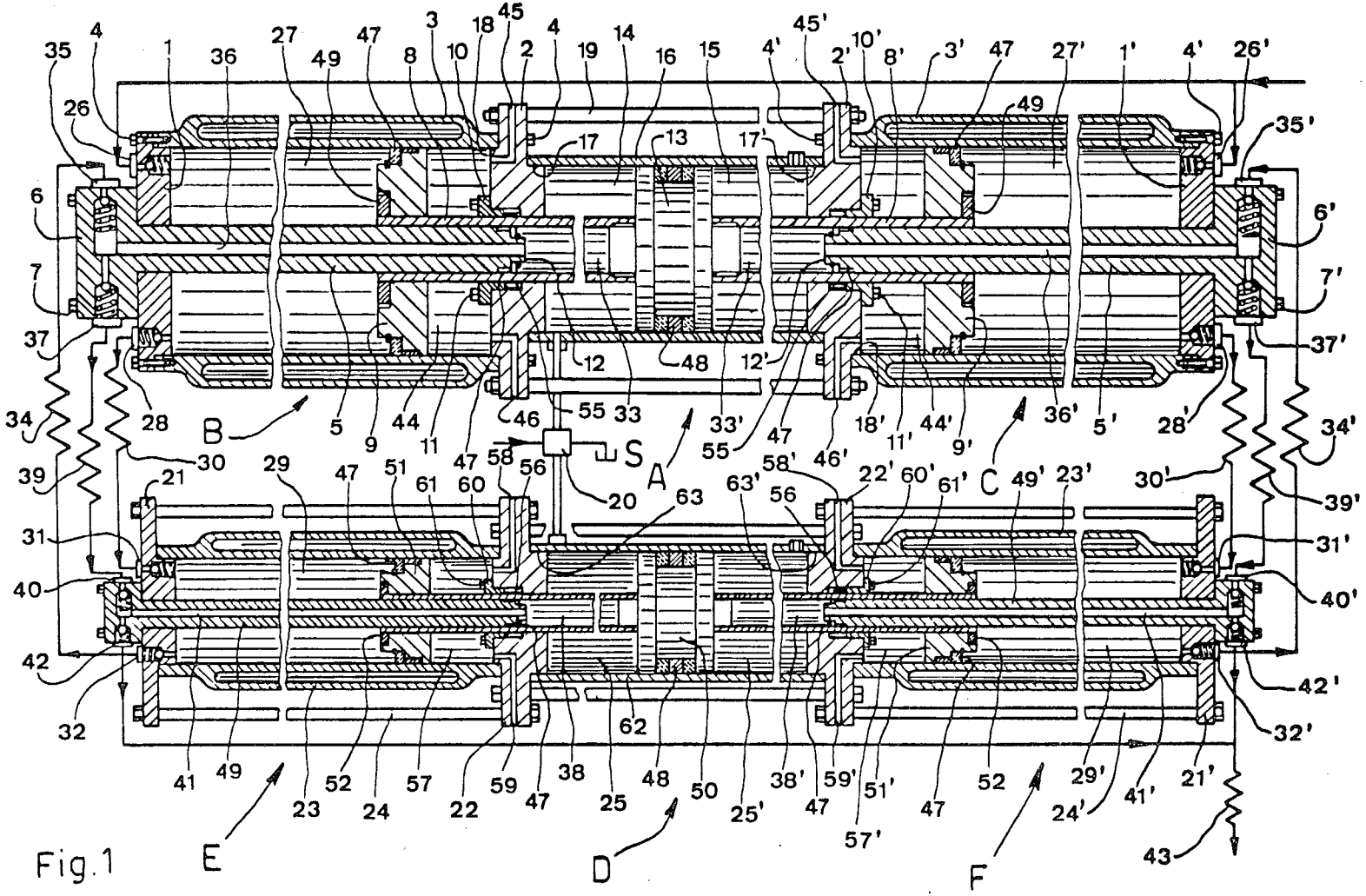
FIG. 1 shows a longitudinal cross section of the four-stage compressor with the two compression units.

A, B and C denote the central section and two lateral sections respectively of the first unit, which comprises the first and third compression stage whether in the four-stage or in the three-stage compressor. Section B is identical to section C.

D, E and F denote the central section and the lateral sections respectively of the four-stage compressor's second unit which comprises the second and fourth compression stages. Section E is identical to section F.

G, H and I denote the central section and the lateral sections respectively of the three-stage compressor's second unit which comprises the second compression stage.

Section H is identical to section I.

1 and 1' denote the cylinder head discs of the two symmetrically opposed cylinders appertaining to stage one, connected with intermediate discs 2 and 2' respectively by way of liners 3 and 3' furnished with means for cooling either by fluid or air, the said discs being attached to the said liners by means of respective screws 4 and 4' and at the same time centred on said liners' external extremity; 5 and 5' denote two bored cylindrical bodies which constitute fixed pistons appertaining to the third stage and incorporating respective heads 6 and 6' serving to fasten the said cylindrical bodies to the external faces of discs 1 and 1' respectively by means of screws 7 and 7'; 8 and 8' denote two cylindrical tubular elements sheated around/sliding along respective bodies 5 and 5' thus constituting rods for pistons 9 and 9' respectively these being fixed to tubular elements 8 and 8' in order to compress the gas within the two sections of stage one. 10 and 10' denote two bushes fixed by means of screws 11 and 11' to intermediate discs 2 and 2' respectively and coupled internally with the external surfaces of tubular elements 8 and 8' respectively in order to enclose the relevant respective oil seals; 12 and 12' denote the respective internal end faces of cylindrical bodies 5 and 5' serving to compress the gas within the two sections of stage three; 13 denote a double acting piston, screwed internally to the facing extremities which incorporate pistons 8 and 8' opposite to the extremities which incorporate pistons 9 and 9', designed to effect alternating movement of the oil contained in the chambers 14 and 15, and pressured by a central hydraulic mover (not indicated); 16 denotes the liners defining that central hydraulic section in which the central piston 13 slides, centred between the abutment shoulders 17 and 17' of discs 2 and 2'; the opposite abutments 18 and 18' of the said discs 2 and 2' serve as centres for the liners 3 and 3' respectively; the assemblage made up by liner 16 and heads 2 and 2' is made fast, coaxially, by means of external tie rods 19.

20 denotes compensating valve which connects with the central hydraulic mover thus to receive the oil demanded by diminished pressure and with discharge valve S for expulsion of excess oil: this valve 20 interconnects oil chamber 14 of the central section of the first unit containing stages one and three with that corresponding chamber in section D or G respectively of the three or four-stage embodiment's second unit.

21 and 21' denote the cylinder head discs of the two symmetrically opposed cylinders appertaining to stage two, connected with the respective intermediate discs 22 and 22' by way of liners 23 and 23' furnished with means for cooling either by fluid or air, the latter centred on and fastened to the said discs by means of external tie-rods 24 and 24'; 25 denotes the oil chamber relative to assemblage D or G of the four- or three-stage embodiment respectively which contains a like volume of oil to that of chamber 14 in assemblage A; 25' denotes an oil chamber identical and opposed to 25; 26 and 26' denote the suction valves for the two sections of stage one which place the latter's chambers 27 and 27' in communication with the reservoir (not indicated) containing gas for compression; 28 and 28' denote the delivery valves for stage one which cause chambers 27 and 27' to intercommunicate with chambers 29 and 29' of the two sections of stage two through the cooling circuit 30 and 30' and by means of the respective suction valves 31 and 31'; 32 and 32' denote the delivery valves for the two sections of stage two, which cause the said second stage chambers 29 and 29' to intercommunicate with chambers 33 and 33' of the two sections of stage three through the cooling coils 34 and 34' respectively and by means of suction valves 35 and 35' and conduits 36 and 36'; 37 and 37' denote delivery valves for the two sections of stage three. 38 and 38' (FIG. 1) denote the fourth stage chambers for the four-stage compressor, which are placed in communication with chambers 33 and 33' of stage three by way of cooling coils 39 and 39', stage three delivery valves 37 and 37', suction valves 40 and 40' of the two sections of stage four, and conduits 41 and 41'. 42 and 42' denote the delivery valves of the fourth stage's two sections which cause chambers 38 and 38' to intercommunicate with the consumer unit's compressed gas reservoir (not indicated) by way of cooling coil 43.

Figure 2:
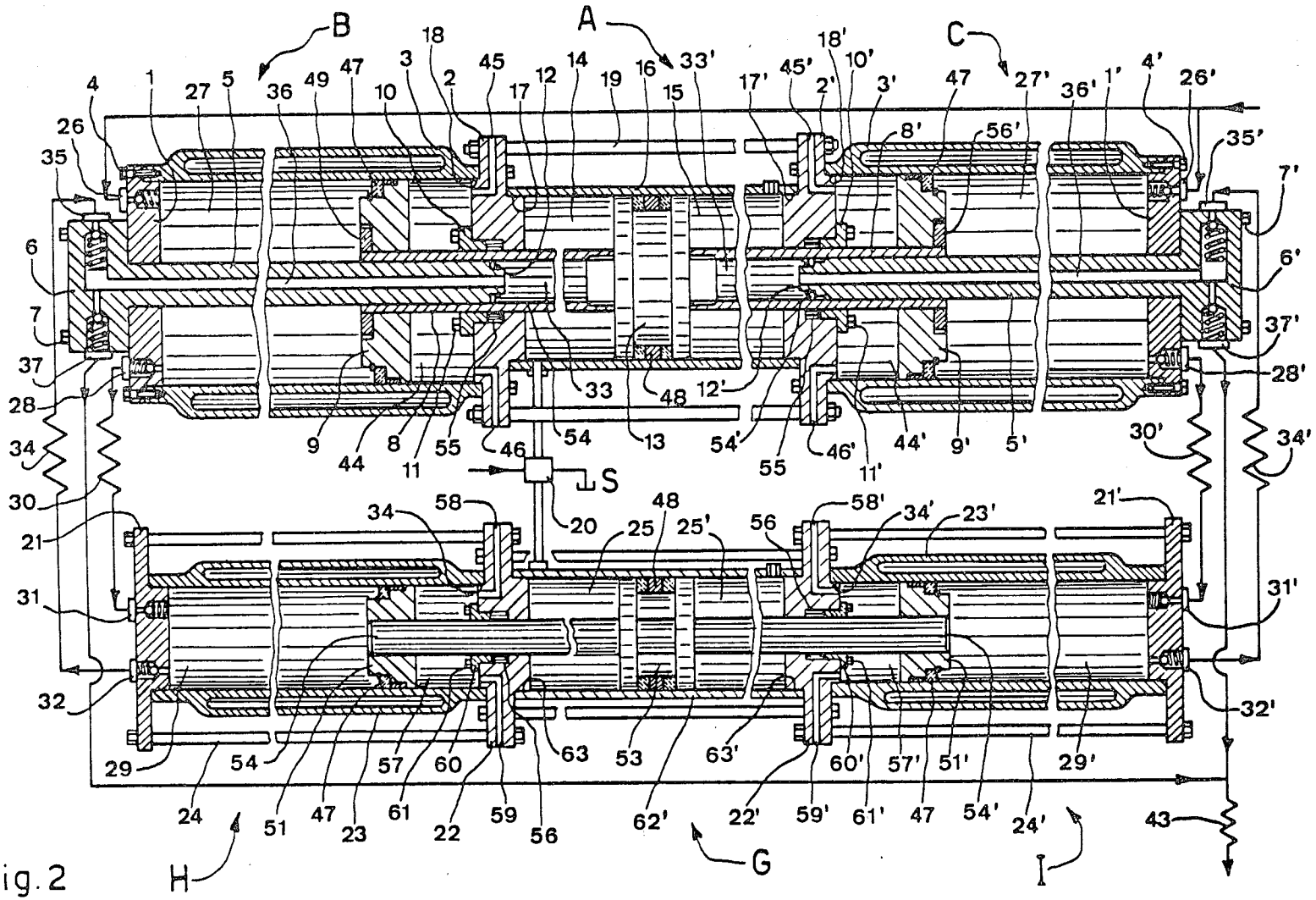
FIG. 2 shows the equivalent cross section as in FIG. 1, relative to the three-stage compressor with two compression units.

In the three-stage embodiment in FIG. 2 the stage three delivery valves 37 and 37' are connected to the cooling coil 43 direct, the latter being linked to the said consumer unit reservoir.

44 and 44' denote those chambers of the two sections of stage one opposed to chambers 27 and 27' of the same stage, which communicate with the outside by way of apertures 45 and 45'respectively.

46 and 46' denote the two actual discharge outlets for oil leaks from the seals located internally of bushes 10 and 10'; gas seals are denoted by 47; oil seals by 48; 49 and 49' (in FIG. 1) denote two cylindrical bodies which constitute the fixed pistons of stage four in the four-stage embodiment, inside which are located coaxially disposed conduits 41 and 41'.

50 denotes the hydraulic piston relative to section D of the four-stage compressor's second unit; 51 and 51' denote the pistons for the two sections of stage two; 52 denotes locking rings for the second stage pistons 51 and 51' of the four-stage embodiment.

52' denotes cylindrical tubular elements, disposed in opposition and sheated around/sliding along respective cylindrical bodies 49 and 49', the said tubular elements constituting rods for the second stage pistons 51 and 51' in the four-stage embodiment. 53 denotes the piston of the central section G in the three-stage compressor's second compression unit.

54 and 54' denote two cylindrical elements which constitute the rods for second stage pistons 51 and 51' of the three-stage embodiment. 55 denotes the oil seals for tubular elements 8 and 8'; 56 denotes the oil seals for the four stage embodiment's tubular elements 52'; 56' denotes locking rings for the first stage pistons 9 and 9'; 57 and 57' denote those stage two chambers opposed to chambers 29 and 29', which communicate with the outside by way of apertures 58 and 58'; 59 and 59' denote the two actual discharge outlets for oil leaks from the seals located internally of those bushes 60 and 60' fixed to intermediate disc 22 and 22' by means of screws 61 and 61'; 62 (in FIG. 1) and 62' (in FIG. 2) denote the respective liners of central sections D and G of the four stage embodiments respective second compression units.

The said liners 62 and 62' are centred onto the abutment shoulders 63 and 63' of discs 22 and 22' respectively. With reference to the four stage compressor in FIG. 1, function is as follows:

when oil is introduced under pressure into chamber 15 the central piston 13 relative to that unit containing stages one and three is caused to move, thus diminishing the volume of chamber 14 and drawing the piston 9' of the second section of stage one thereby creating suction through valve 26' of that section: at the same time the first stage piston 9 is pushed, thus occasioning egress of gas through valve 28 of the first section towards valve 31 of the second stage's first section and producing a compression in chamber 29 of a lower order than that of 27, according to the predetermined ratio: the oil occupying chamber 14 is conveyed through valve 20 into the chamber 25 of assemblage D central to the unit comprising stages two and four, and pushes central piston 50, causes the volume of oil in chamber 25' to diminish by discharging into the hydraulic central mover's reservoir; in addition piston 51 of the second stage's first section is drawn thus producing suction of gas from the first section of stage one through valves 28 and 31; furthermore, and concurrently, piston 51' of the second section of stage two is pushed, occasioning a compression of gas towards chamber 33' of the third stage's second section ultimately of a lower order than that in chamber 29', by way of valves 32' and 35', coil 34' and conduit 36'; the movement of the central piston 13 in reducing chamber 14 also serves to reduce chamber 33 of the third stage's first section, this last producing a compression of the gas within chamber 38 of the first section of stage four, of lesser dimensions than said chamber 33, by way of valves 37 and 40, coil 39, and the conduit 41 appertaining to fixed cylindrical body 49; at the same time the second unit's central piston 50 reduces the volume of chamber 38' in the second section of stage four thereby producing a compression of gas towards the consumer unit's reservoir by way of conduit 41', valve 42' and coil 43; by introduction of oil into the chamber 25', that opposed to chamber 25, the cycle will be repeated in reverse, occasioning suction of gas through valve 26 first section of stage one, and delivery to the consumer unit through valve 42 of the first section of the fourth stage.

The function of the three stage compressor illustrated in FIG. 2 is similar in every respect to that of the four stage compressor in FIG. 1.

Clearly, as there is no fourth compression stage, the gas compressed within compression stage three is conveyed direct to the consumer unit by way of the delivery valves 37 and 37', and the cooling coil 43. Notwithstanding the invention's description herein referring to a preferred embodiment of same it shall be understood that it is not to be limited thus, as it may be subject to practical modifications essentially within the scope of the invention as defined by the appended claims.

I claim:

1. A multistage reciprocating gas compressor with at least three compression stages, comprising: a first and a second compression unit each consisting of three longitudinally aligned cylinder sections; a central hydraulic section comprised of a central cylinder closed at each end and divided into two opposed hydraulic chambers by a central hydraulically operated piston; a lateral gas compression section aligned on each end of the central section, each gas compression section comprised of a cylinder closed at a first end by a respective end of the central section and closed at a second end, and provided with a primary compression piston connected to and driven by said hydraulically operated piston and defining a primary compression stage; the first compression unit having a central bored out rod extending from said second end of each lateral compression section and telescoping in a movable hollow cylinder connecting each primary compression piston with the hydraulic piston whereby the hollow cylinder and bored out rod constitutes a compression section of a secondary compression stage; the primary and secondary compression stage of the first compression unit constituting the first and third compression stage of the gas respectively, and the primary compression stage of the second compression unit constituting the second compression stage of the gas.

2. A multistage gas compressor according to claim 1, wherein the second compression unit has a central bored out rod extending from said second end of each lateral compression section and telescoping in a movable hollow cylinder connecting each primary compression piston with the hydraulic piston, the hollow cylinder and bored out rod defining a compression section of a secondary compression stage; the secondary compression stage of the second compression unit constituting the fourth compression stage of the gas.

3. A three stage gas compressor according to claim 1, wherein a first gas flow conduit connects a reservoir containing gas for compression with suction valves associated with each lateral compression section of the first compression unit; a second and third gas flow conduit connects a delivery valve associated with each lateral gas compression section of the first compression unit with a suction valve associated with the corresponding lateral gas compression section of the second compression unit; a fourth and fifth gas flow conduit connects a delivery valve associated with each lateral gas compression section of the second compression unit with a suction valve associated with the corresponding compression section of the secondary compression stage of the first compression unit; and a sixth gas flow conduit connects delivery valves associated with the secondary compression stage of the first compression unit with a consumer unit.

4. A four stage gas compressor according to claim 1 or 2, wherein a first gas flow conduit connects a reservoir containing gas for compression with suction valves associated with each lateral compression section of the first compression unit; a second and third gas flow conduit connects a delivery valve associated with each lateral gas compression section of the first compression unit with a suction valve associated with the corresponding lateral gas compression section of the second compression unit; a fourth and fifth gas flow conduit connects a delivery valve associated with each lateral gas compression section of the second compression unit with a suction valve associated with the corresponding compression section of the secondary compression stage of the first compression unit; a sixth and seventh gas flow conduit connects a delivery valve associated with each compression section of the secondary compression stage of the first compression unit with a suction valve associated with the corresponding compression section of the secondary compression stage of the second compression unit; and an eighth gas flow conduit connects delivery valves associated with the secondary compression stage of the second compression unit with a consumer unit.

* * * * *